US007684571B2

(12) United States Patent
Grosvenor et al.

(10) Patent No.: US 7,684,571 B2
(45) Date of Patent: Mar. 23, 2010

(54) SYSTEM AND METHOD OF GENERATING AN AUDIO SIGNAL

(75) Inventors: David Arthur Grosvenor, Frampton Cotterell (GB); Guy de Warrenne Bruce Adams, Stroud (GB); Shane Dickson, Horfield (GB)

(73) Assignee: Hewlett-Packard Development Company, L.P., Houston, TX (US)

( * ) Notice: Subject to any disclaimer, the term of this patent is extended or adjusted under 35 U.S.C. 154(b) by 1308 days.

(21) Appl. No.: 11/159,977

(22) Filed: Jun. 23, 2005

(65) Prior Publication Data

US 2005/0286728 A1 Dec. 29, 2005

(30) Foreign Application Priority Data

Jun. 26, 2004 (GB) ..... 0414364.0

(51) Int. Cl.
*H04R 3/00* (2006.01)

(52) U.S. Cl. ..... 381/92; 381/122; 381/104; 348/169; 367/104

(58) Field of Classification Search ..... 381/92, 381/107, 122, 91, 111, 104–109; 348/231.4, 348/462, 208.16, 211.9, 169; 367/99, 104
See application file for complete search history.

(56) References Cited

U.S. PATENT DOCUMENTS 6,275,258 B1 * 8/2001 Chim ..... 348/211.12
6,600,824 B1 * 7/2003 Matsuo ..... 381/92
6,757,397 B1 * 6/2004 Buecher et al. ..... 381/122
7,130,705 B2 * 10/2006 Amir et al. ..... 700/94
2002/0089645 A1 7/2002 Mason

FOREIGN PATENT DOCUMENTS

EP 0615387 A 9/1994
JP 2000333300 A 1/2000
JP 2000004493 A 2/2000

OTHER PUBLICATIONS

Search Report dated Nov. 22, 2004.

* cited by examiner

*Primary Examiner*—Vivian Chin
*Assistant Examiner*—Jason R Kurr

(57) ABSTRACT

A method of generating an audio signal comprises receiving a plurality of input audio signals from a plurality of microphones forming a microphone array, the plurality of input audio signals being representative of a set of sound sources within the auditory field of view of the microphone array at a given instant in time; receiving a motion input signal from a motion sensor, the motion input signal being representative of the motion of the microphone array; and manipulating the received plurality of input audio signals in response to the received motion input signal to generate an audio output signal that is representative of a set of sound sources within the auditory field of view of a virtual microphone, the apparent motion of the virtual microphone being independent of the motion of the microphone array.

16 Claims, 14 Drawing Sheets

SYSTEM AND METHOD OF GENERATING AN AUDIO SIGNAL

TECHNICAL FIELD

The present invention relates to the field of image capture.

CLAIM TO PRIORITY

This application claims priority to copending United Kingdom utility application entitled, "SYSTEM AND METHOD OF GENERATING AN AUDIO SIGNAL," having Ser. No. GB 0414364.0, filed Jun. 26, 2004, which is entirely incorporated herein by reference.

BACKGROUND

In the fields of video and still photography the use of small, lightweight cameras mounted on a person's body is now well known. Furthermore, systems and methodologies for automatically processing the visual information captured by such cameras is also developing. For example, it is known to automatically determine the subject within an image and to zoom and/or crop the image, or stream of images in the case of video, to maintain the subject substantially with the frame of the image, or to smooth the transition of the subject across the image, regardless of the actual physical movement of the camera. This may occur in real time or as a post processing procedure using recorded image data.

Although such small cameras often include a microphone, or are able to receive an audio input signal from a separate microphone, the audio signal captured tends to be very simple in terms of the captured sound stage. Typically, the audio signal simply reflects the strongest set of sound sources captured by the microphone at any given moment in time. Consequently, it is very difficult to adjust the sound signal to be consistent with the manipulated video signal.

The same problem is faced even if it is desired to capture an audio signal only using a small microphone mounted on a person. In this situation, the audio signal tends to vary markedly as the person moves. This is particularly true if the microphone is mounted on a person's head. Even when concentrating visually on a static object, a person's head may still move sufficiently to interfere with the successful sound capture. Additionally, there may be instances where a user's visual attention is momentarily diverted away from the main source of interest to which it is desirable to maintain the focus of the sound capture system. These motions of a user's head thus cause rapid changes in the sounds detected by the sound capture system.

SUMMARY

According to an exemplary embodiment, there is provided a method of generating an audio signal, the method comprising receiving a plurality of input audio signals from a plurality of microphones forming a microphone array, the plurality of input audio signals being representative of a set of sound sources within the auditory field of view of the microphone array at a given instant in time; receiving a motion input signal from a motion sensor, the motion input signal being representative of the motion of the microphone array; and manipulating the received plurality of input audio signals in response to the received motion input signal to generate an audio output signal that is representative of a set of sound sources within the auditory field of view of a virtual microphone, the apparent motion of the virtual microphone being independent of the motion of the microphone array.

BRIEF DESCRIPTION OF THE DRAWINGS

Embodiments of the present invention are now described, by way of illustrative example only, with reference to the accompanying figures, of which.

DETAILED DESCRIPTION

Figure 1:
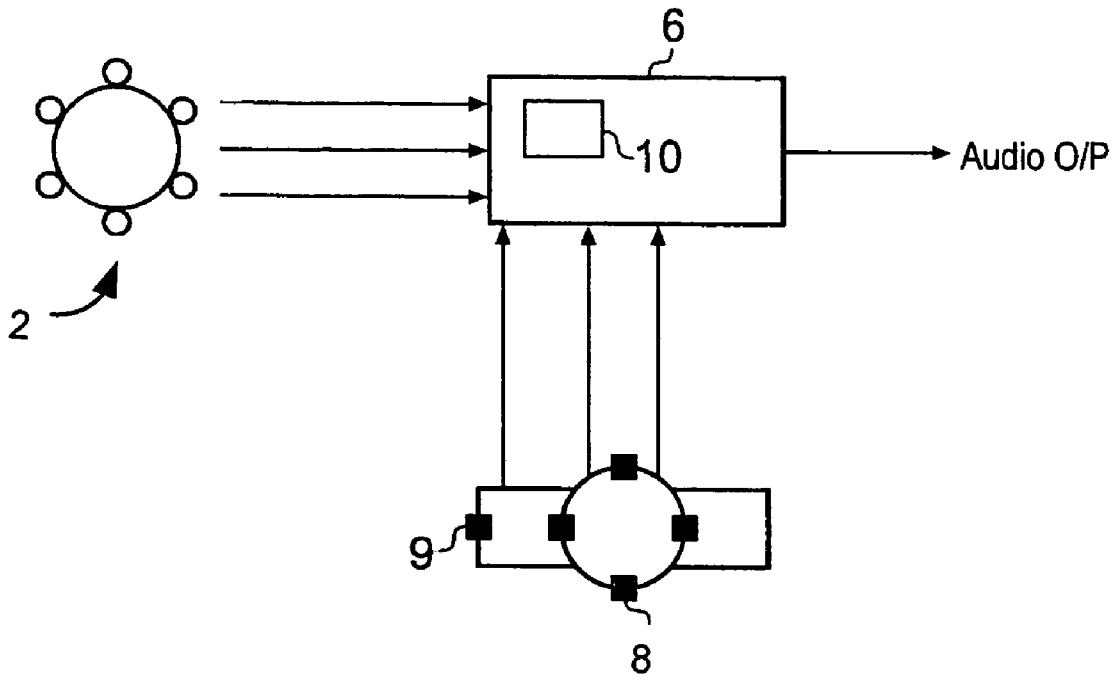
FIG. 1 schematically illustrates a head mounted spatial sound capture system in accordance with an embodiment of the present invention.

FIG. 1 schematically illustrates a sound capture system embodiment. An array 2 of individual head mounted microphones 4 is coupled to a data processor 6. The angular range, or auditory field of view, of each microphone 4 within the array 2 is such that for neighbouring microphones there is an overlap of their respective auditory fields of view. As a consequence, the resultant auditory field of view of the entire array is broad, preferably 360°. Furthermore, the overlapping of auditory field of views of neighbouring microphones allows a sound source to be located by triangulation. Each microphone 4 may be coupled to the data processor 6 utilising separate communications means, for example, individual wires, or alternatively, the individual microphones 4 may be coupled to the data processor 6 utilising a common communication channel, such as a conventional data bus or wireless communication channels. Also provided in communication with the data processor 6 is one or more motion sensors 8. The motion sensor 8 is arranged to provide a signal to the data processor indicative of the motion of the motion sensor, and is preferably mounted on the same physical structure as the microphone array. The motion sensor thus also provides signals indicative of the motion of the microphone array 2. A further motion sensor 9 may also be provided preferably mounted on a separate structure to the microphone array, for example, on a user's body. The data processor 6, preferably includes data storage means 10 on which the signals received from the microphone array 2 and motion sensor 8 may be stored and retrieved for subsequent processing by the data processor 6. The data processor 6 provides an audio output signal that is generated by modifying the audio signals received from the individual microphones 4 in the array 2. The output audio signal may, for example, be a stereo signal or a DVD-audio signal. As will be appreciated by those skilled in the art, some data processing may be applied to the signals received from the microphone array and/or the motion sensors prior to the processed data being stored on the data storage means 10. Consequently, a correspondingly reduced amount of subsequent data processing will be required after data retrieval. The data processor 6 and microphones 4 may be further arranged such that the operation of one or more of the microphones 4 may be controlled in response to signals provided by the data processor 6.

Mounting sound capture system on a user's head has many advantages. When used in conjunction with a head mounted camera, the same power supply, data storage or communication systems as already provided for the camera system may be shared by the sound capture system. Moreover, spectacles or sunglasses provide a good position to mount an array of microphones that have a wide field of view about the person wearing the spatial sound capture system. Furthermore, a spectacle safety line that prevents the spectacles or sunglasses from accidentally falling off the person's head, as are already widely used by sports persons, may further provide additional mounting points for further microphones to provide a complete 360° auditory field of view.

The data processing of the audio signals from the microphones 4 allows the recorded audio to be manipulated in a number of ways. Primary among these is that the signals from the plurality of microphones 4 within the array can be combined so that the resultant signal appears to be produced by a single microphone. By appropriate processing of the individual audio signals the location and audio characteristics of this 'virtual microphone' may be adjusted. For example, the audio signals may be processed to generate a resultant output audio signal that corresponds to that which would have been provided by a single directional microphone located close to a specific sound source. On the other hand, the same input audio signals may be combined to give the impression the output audio signal was recorded by a non-directional microphone, or plurality of microphones, arranged to record an overall sound stage.

A further way of manipulating the microphone signals is to compensate for the movement of the microphone array, using the signal from the motion sensor 8. This allows the 'virtual microphone' to be stabilised against involuntary movement and/or to be kept apparently focused on a particularly sound source even if the actual microphone array 2 has physically moved away from that sound source. Although a preferred feature of embodiments of the present invention, the presence of one or more motion sensors 8 is not essential. For example, the stabilisation of the output audio signal against involuntary movement of the microphone array 2 can be achieved solely by appropriate processing of the received input signals from the microphone array 2 over a given period of time. However, this is relatively computationally intensive and the addition of at least one motion sensor 8 greatly reduces the processing required.

Figure 2:
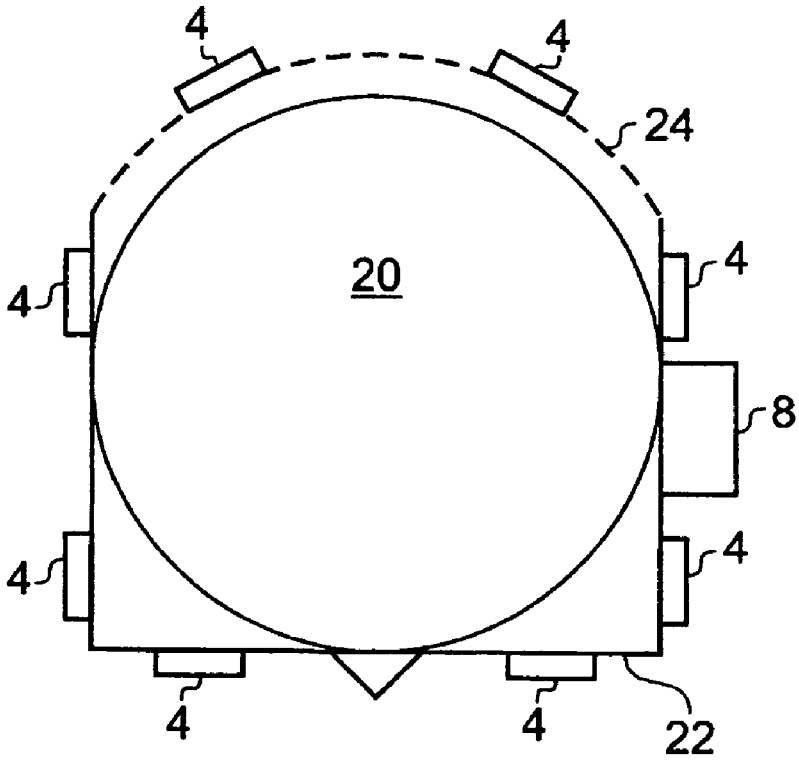
FIG. 2 is an illustrative example of head mounted microphone array according to embodiments of the present invention.

A possible physical embodiment of the sound capture system shown schematically in FIG. 1 is illustrated in FIG. 2. A user's head 20 is shown in plan view. A number of individual microphones 4 are mounted on a frame 22 that is arranged to be worn on the user's head 20. The frame 22 may, for example, be closely analogous to a pair of spectacles. In a preferred embodiment, the arms of the frame that pass along the side of the user's head are joined at their rear extremity by a cord 24 or fabric strap on which further microphones 4 may be secured, thereby providing complete auditory coverage around the user's head 20. The frame 22 and cord or strap 24 may be fashioned to resemble a pair of sports sun spectacles having a safety, or retaining, strap as is currently conventionally used in sporting activities such that the sound capture system is relatively unobtrusive. Affixed to the frame 22 is a motion sensor 8, which in preferred embodiments comprises a small video camera. However, other conventional motion sensors 8 such as gyroscopes may also be used. The microphones 4 and motion sensor 8 are coupled to a data processor 6 that need not be mounted to the frame 22, and is therefore not illustrated in FIG. 2. It is envisaged that in preferred embodiments of the present invention, the data processor 6 will be either carried elsewhere on the user's person, for example, on a waist strap or within a jacket pocket, or may be remotely located from the user all together. The signals from the microphones 4 and motion sensor 8 in the first scenario may be coupled by conventional cables to the data processor 6, or alternatively by wireless communication means, and in the latter example will preferably be in communication with the data processor 6 by wireless communication.

Figure 3:
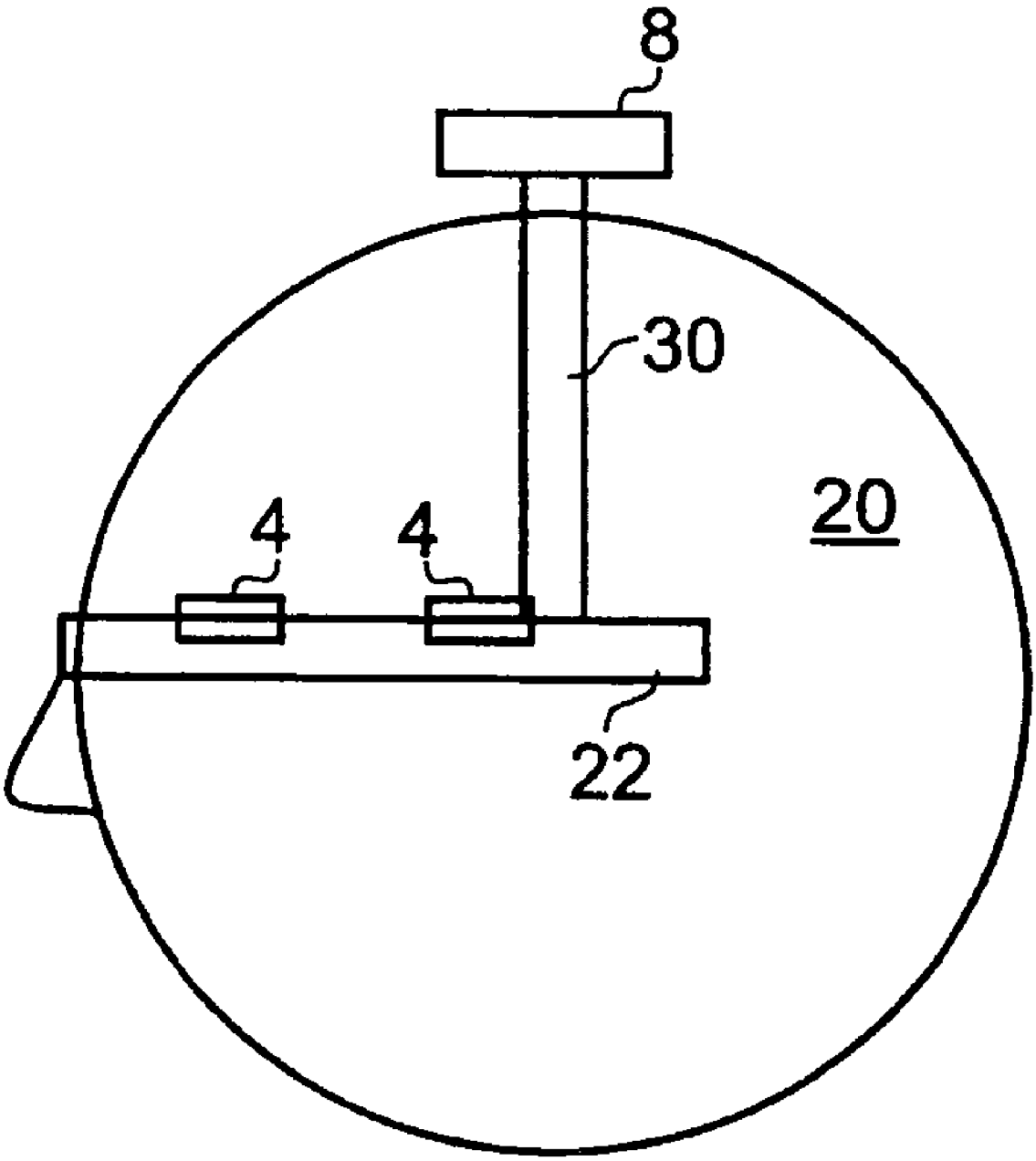
FIG. 3 is a further example of a head mounted microphone array according to further embodiments of the present invention.

An alternative physical arrangement of the frame 22 supporting the microphones 4 and motion sensor 8 is shown in FIG. 3. The user's head 20 is shown in profile and the frame 22 and microphones 4 are illustrated in the form of a spectacles type frame as described with reference to FIG. 2. However, extending vertically from the frame 22 in a curved loop that passes over the top of user's head 20, is a further support 30 at the top of which is mounted the motion sensor 8. An advantage of the arrangement shown in FIG. 3 is the even distribution of weight across the frame 22 as compared to the arrangement shown in FIG. 2. However, the details of the mounting arrangement for the sound capture system according to embodiments of the present invention are not restricted to those illustrated and various physical arrangements may be adopted to suit particular circumstances or applications.

As previously mentioned, the present invention is concerned with the stabilisation in same manner of the output sound signal with respect to the received input sound signals and motion information of the microphone array. It will be appreciated that the required stabilisation may be accomplished in a number of different ways and the term is used herein in a generic manner. One manner in which stabilisation may be modeled is by a process of determining a virtual microphone trajectory whose motion is damped with respect to the motion of the original microphone or microphone array. The process of stabilisation can also be considered as the smoothing or damping of the variation over time of one or more attributes that together define the characteristic to be stabilised. In embodiments of the present invention, two strategies are proposed to implement the desired damping of certain attributes. First, individual attributes are damped or smoothed before being used to determine the desired characteristic, which is now considered stabilised. Second, some measure or metric of the characteristic to be stabilised is created and applied to a number of "candidate" stabilised characteristics generated by varying the attributes defining the characteristic. The candidate stabilised characteristic having a value of the measure or metric closest to a determined optimum value is selected as the stabilised characteristic. Various implementations of these strategies are described herein, with reference to FIGS. 4 to 14.

Figure 4:
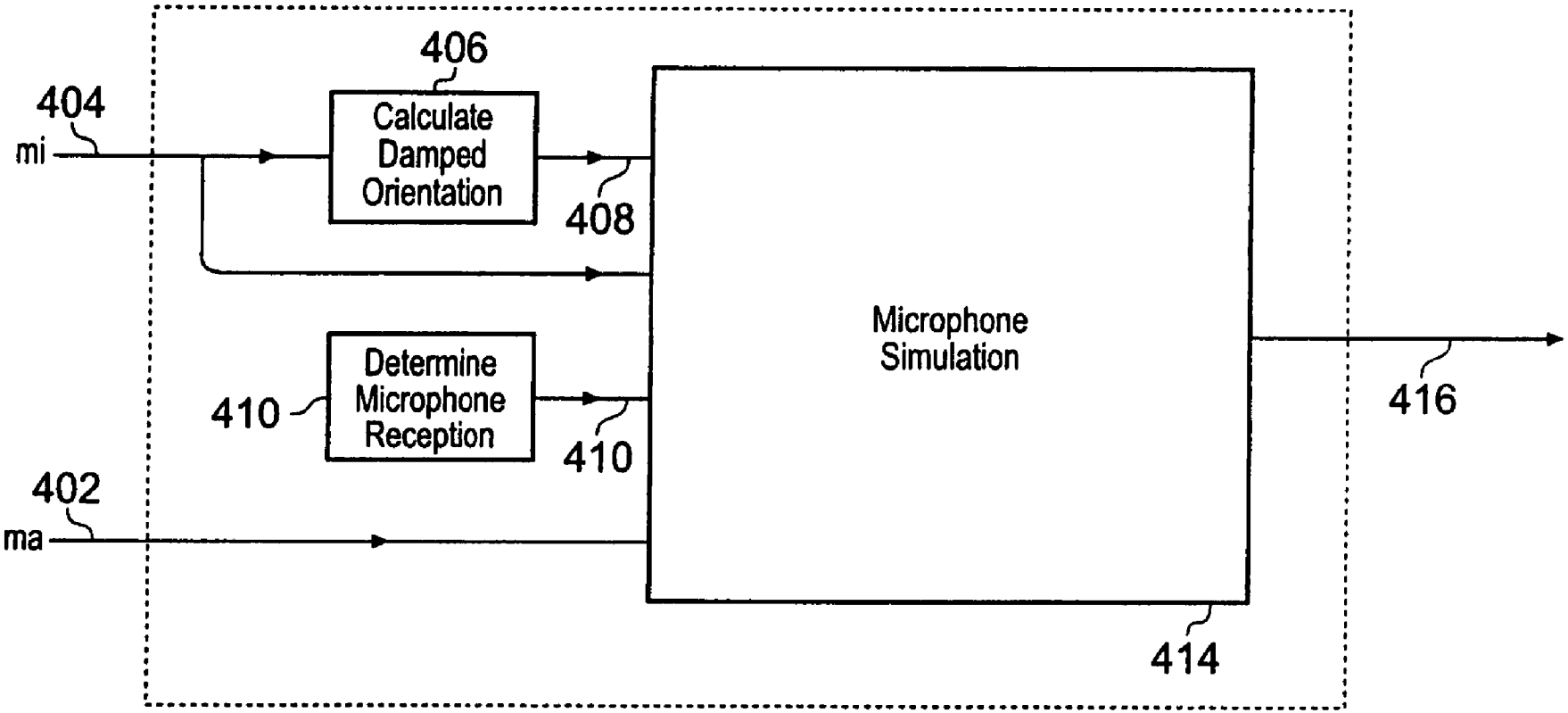
FIG. 4 schematically illustrates an arrangement for performing audio stabilisation by mixing microphone signals in accordance with an embodiment of the present invention.

FIG. 4 schematically illustrates a method of audio stabilisation according to an embodiment of the present invention based upon mixing the different microphone array signals. A microphone array signal 402 comprising the input signals from the microphones of the array is provided, together with a motion signal 404 that is indicative of the motion of the microphone array. The motion signal 404 is provided as an input to an orientation module 406 that is arranged to provide a damped or smoothed orientation signal 408 that represents the orientation of the output virtual microphone. In embodiments of the present invention, the orientation of the microphone array is a measure of the deviation of the microphone array from the tangent of the path of the array. For a head mounted microphone array as illustrated in FIGS. 2 and 3, this corresponds to the wearer looking to either side. The tangent of the path of the array can easily be derived by calculating the differential of the position information of the array, which is extracted by the orientation module 406 from the motion signal 404. A method of calculating the damped orientation signal is described in more detail with reference to FIG. 5.

Referring still to FIG. 4, an initial or default field of view, or reception, signal 410 is determined by a microphone reception module 412. In the embodiment illustrated by FIG. 4, the field of view of the microphone array is considered to be constant. The damped orientation signal 408, motion signal 404, microphone reception signal 410 and microphone array signal 402 are provided as inputs to a microphone simulation module 414 that combines the signals so as to provide an output audio signal 416 that represents the stabilised output signal from a virtual microphone. Methods of combining the input signals are discussed in more detail with reference to later figures.

Figure 5:
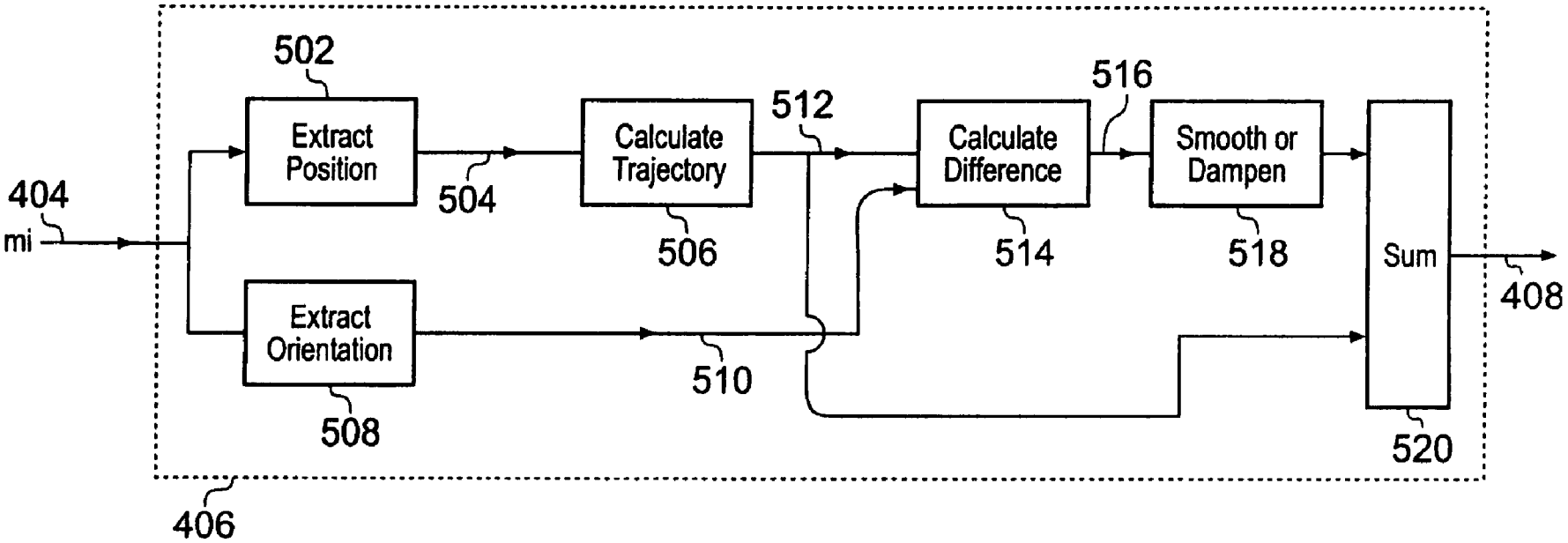
FIG. 5 schematically illustrates an arrangement of the orientation module of FIG. 4.

FIG. 5 schematically illustrates an implementation of the orientation module 406 shown in FIG. 4. The motion signal 404 representative of the motion of the microphone array is provided as an input to a position extraction module 502 that is arranged to extract the position of the microphone array from the motion signal 404. The extracted position signal 504 is provided as an input to a trajectory module 506 that determines the trajectory of the microphone array by calculating the derivative of the position signal 504. The motion signal 404 is also provided as an input to an orientation extraction module 508 that is arranged to extract the orientation of the microphone array.

The resulting orientation signal 510 and the trajectory signal 512 output by the trajectory module 506 are both provided as inputs to a difference module 514. The difference module 514 calculates the difference between the trajectory signal 512 and the orientation signal 510. As mentioned above, in the case of a head mounted microphone array the difference represents how far to one side the person has moved their head. The result of the calculation from the difference module 514 is provided as a difference signal 516 and is input to a damping module 518 that applies a damping function to the difference signal 516. The damping function may comprise the application of a known filter function, such as an FIR low-pass filter, an IIR low-pass filter, a Wiener filter or a Kalman filter, although this list should not be considered exhaustive. Constraints on the damping may also be applied in addition or as an alternative to applying a filter, for example, constraining the maximum difference or the rate of change of the difference.

The damped difference signal 518 and the trajectory signal 512 are both provided as inputs to a summing module 520 that adds the damped difference signal 518 to the trajectory signal 512, thus producing an output signal 408 that is representative of a damped version of the original orientation signal 510. The damped orientation signal 408 is provided to the microphone simulation module 414, as shown in FIG. 4.

Figure 6:
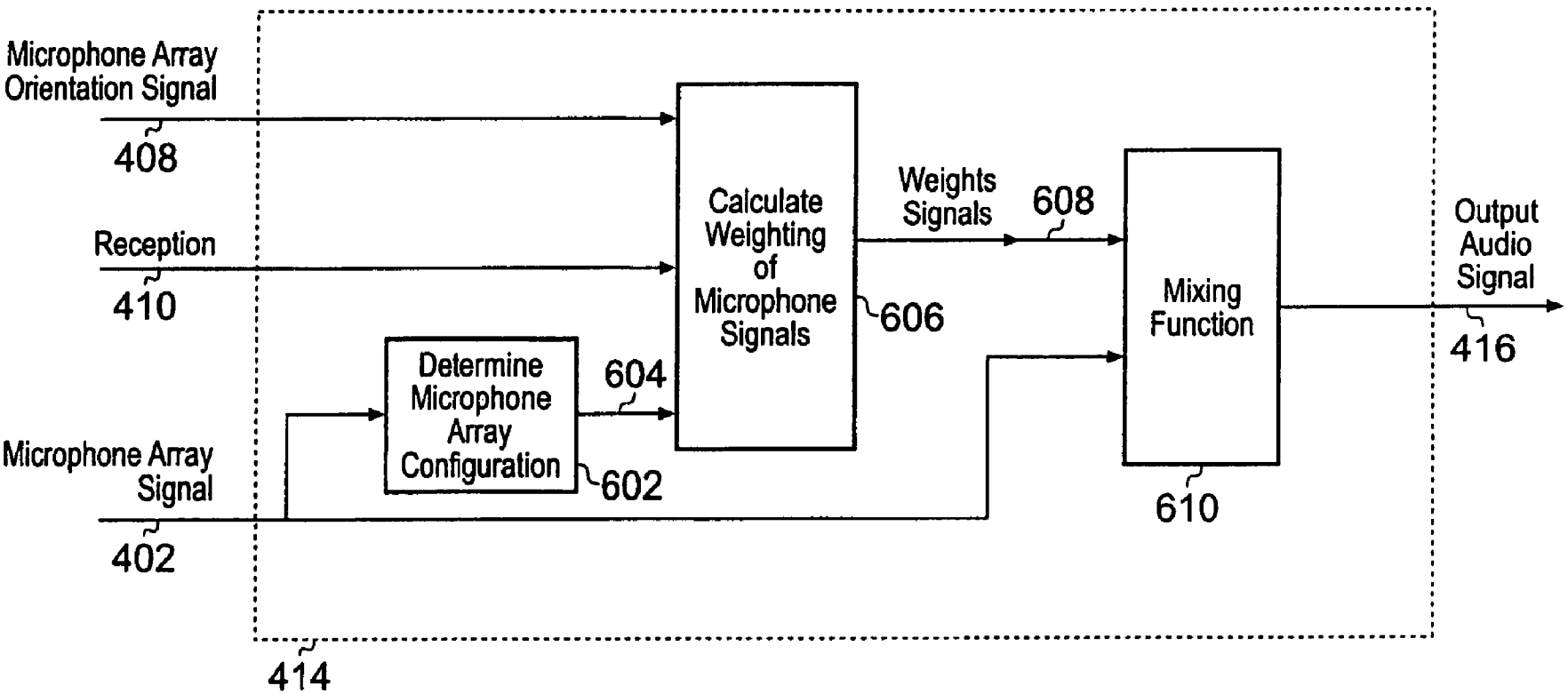
FIG. 6 schematically illustrates an implementation of the microphone simulation module of FIG. 4.

FIG. 6 schematically represents an implementation of microphone simulation module 414 shown in FIG. 4, in which the microphone simulation involves mixing the individual signals from the microphones of the microphone array. As shown, the simulation module 414 receives the damped microphone orientation signal 408, the reception signal 410 and the microphone array signal 402 as inputs. The microphone array signal 402 is input to an array configuration module 602 that determines the configuration of the microphone array. The configuration is a function of the position and orientation of each microphone within the array. In most circumstances, it is envisaged that the configuration of the microphone array will be static and as a consequence, in simplified embodiments, the array configuration module 602 may be omitted, with a configuration signal either being provided as a pre-set signal or omitted completely. However, in the embodiment shown in FIG. 6, the array configuration module 602 provides an array configuration signal 604 that takes into account any changes in the array configuration that may occur over time.

The damped microphone orientation signal 408, reception signal 410 and the array configuration signal 604 are input to a weighting module 606. As previously stated, the function of the microphone simulation module 414 is to take the signals from the microphone array, together with particular motion characteristics, and generate a sound signal that would have resulted from a particular virtual microphone. The simulation typically produces the sound signal of a microphone moving with the original motion of the microphone array but with defined reception and damped orientation. This can be achieved by applying a weighting to the signals from the microphone array, the weighting varying over time, and subsequently applying a linking function to the weighted signals. The weighting module 606 is arranged to determine an appropriate weighting signal for each of individual microphone signals within the microphone array signal 402, based on the input signals. The weighting signals are provided as inputs to a mixing module 610, which also receives the microphone array signal 402. The mixing module applies the microphone weightings to the respective individual microphone signals to generate the simulated output audio signal 416. In embodiments of the present invention in which a multichannel output is generated, for example, stereo or surround sound, the mixing module is arranged to apply multiple weightings to the microphone signals and in some embodiments apply different mixing functions. The weighting signals 608 may be applied to individual microphone signals by varying such signal properties as amplitude and frequency components.

Figure 7:
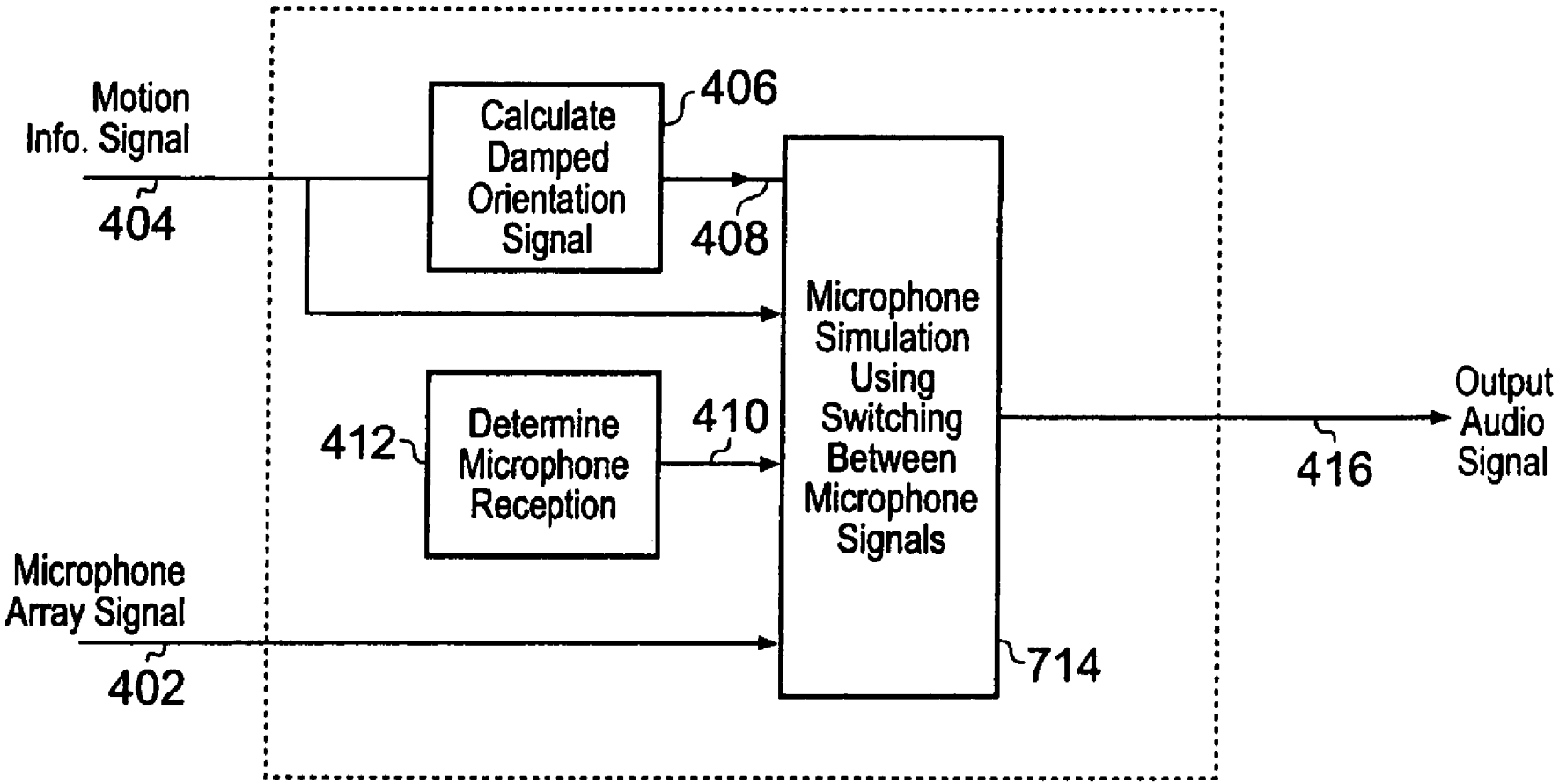
FIG. 7 schematically illustrates an arrangement for performing audio stabilisation by switching microphone signals in accordance with a further embodiment of the present invention.

An alternative approach to the microphone simulation from the microphone signal mixing described above is simulation using switching between microphone signals. FIG. 7 schematically illustrates such an implementation. In an analogous manner to the microphone mixing arrangement shown in FIG. 4, a damped orientation signal 408, motion information signal 404, microphone reception signal 410 and microphone array signal 402 are provided as inputs to a microphone simulation module 714. As a function of orientation, motion and reception signal, the simulation module 714 determines which of the individual microphone signals from the array signal 402 is to be selected and thus provided as the output audio signal 416. Any discontinuities in the output signal caused by transitions between different individual microphone signals may be reduced by the simulation module by applying a blending function during the transition.

The embodiments described above with reference to FIGS. 4 to 7 have varied the orientation of the virtual microphone by switching or mixing the microphone signals. However, other parameters may be varied such that the trajectory of the simulated microphone can be varied, as well as the apparent position and reception (field of view) of the simulated microphone.

Figure 8:
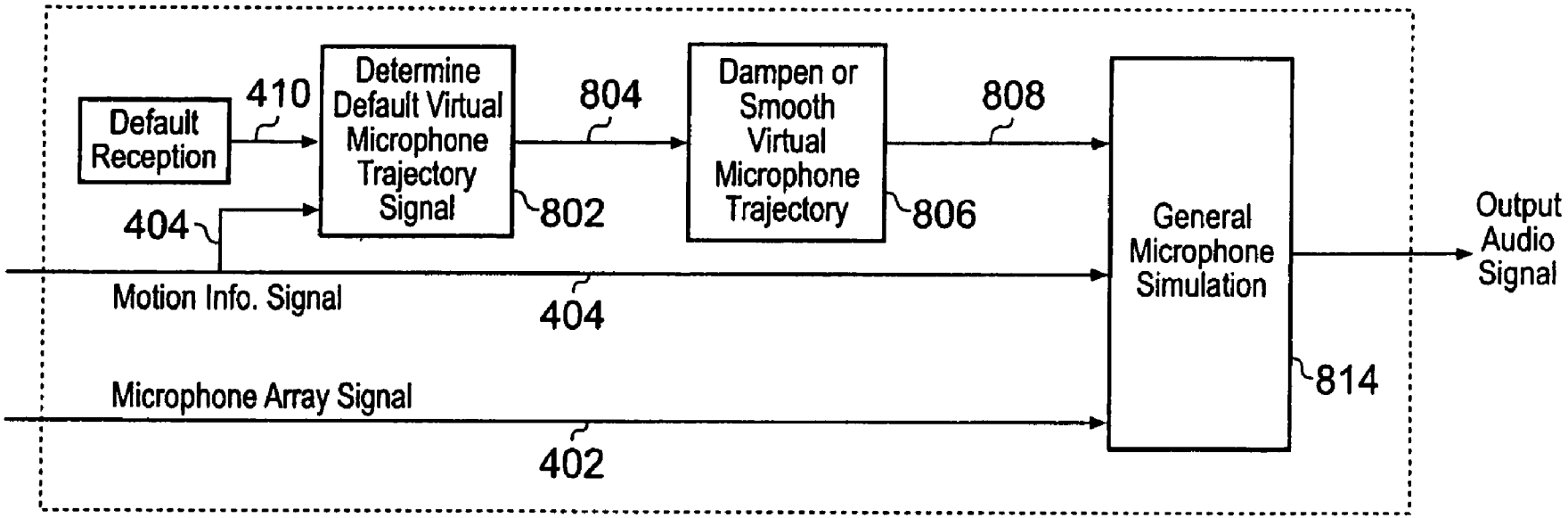
FIG. 8 schematically illustrates an arrangement for performing audio stabilisation according to a further embodiment of the present invention by damping the virtual microphone trajectory.

FIG. 8 schematically illustrates an embodiment of the present invention that provides some stabilisation of the audio signals by damping the virtual microphone trajectory. A virtual trajectory module 802 receives a default reception signal 410 and the motion information signal 404 as inputs and derives a virtual microphone trajectory signal 804 as a function of the two input signals. The virtual microphone trajectory signal 804 is thus a time varying signal that can be smoothed or damped. In the embodiment shown in FIG. 8, the virtual microphone trajectory signal 804 is provided as an input to a damping module 806 that generates a damped trajectory signal 808. The damping module is arranged to apply one or more damping functions to the trajectory signal 804 to reduce the difference in both the position and orientation of the virtual microphone. This will generally involve specifying the trade-off between the position and orientation objectives, or the adoption of multi-objective damping functions. For example, the position of the virtual microphone may be constrained to vary only whilst enclosed by the actual microphone array or when close to the array so that the accuracy of the simulation is maximised. The time window over which the damping occurs may also vary. The damped microphone trajectory signal 808 is provided as an input to a microphone simulation module 814, which also receives the motion information signal 404 and the microphone array signal 402, the simulation module generating the final output audio signal of the virtual microphone.

Figure 9:
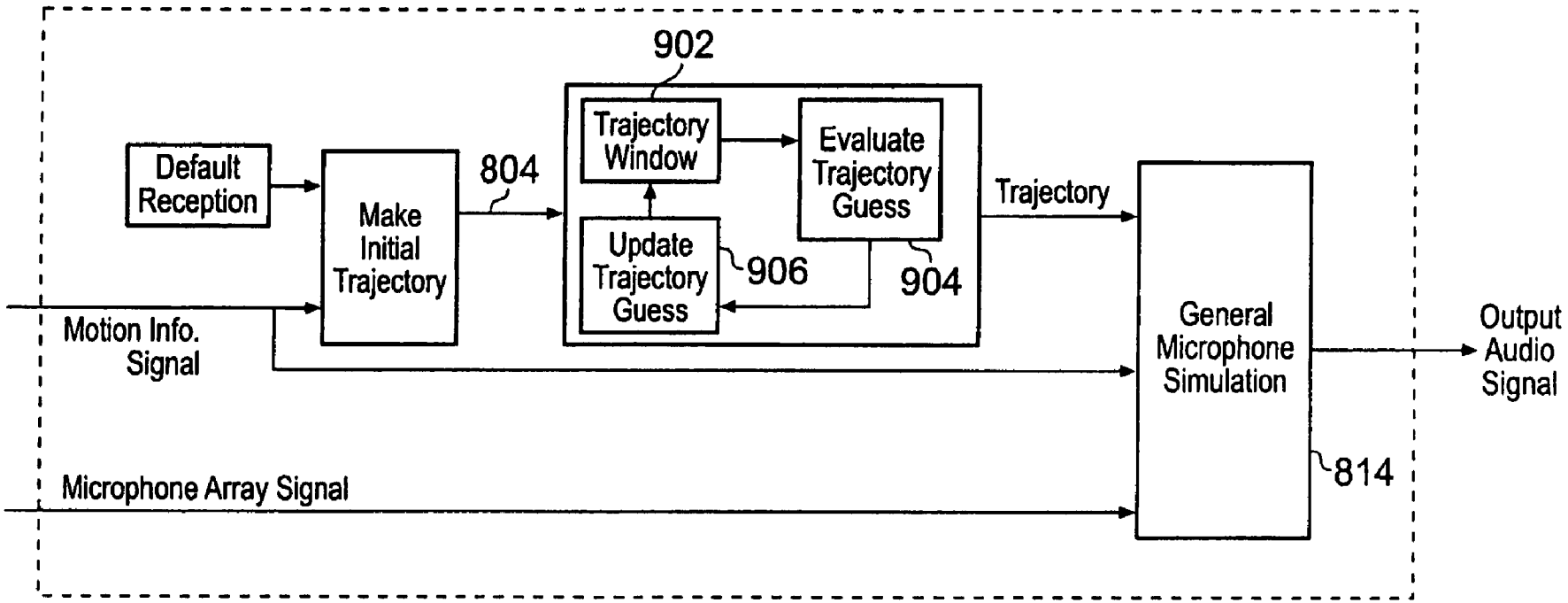
FIG. 9 schematically illustrates an implementation of the arrangement shown in FIG. 8 in which the trajectory damping is performed iteratively.

FIG. 9 illustrates an embodiment of the present invention in which damping of microphone trajectory signal 804 is accomplished using a search, or iterative, approach. The initial trajectory signal 804 is provided as an input to a buffer 902 that is arranged to store the un-damped trajectory signal for the time window that smoothing occurs over. The buffer contents are provided as an input to an evaluation module 904 that is configured to evaluate the buffer contents, i.e., trajectory signal, against one or more constraints or criteria. If the buffered trajectory signal does not confirm to pre-determined conditions, it is provided as an input, together with evaluation data, to a trajectory modification module 906 that is arranged to modify the trajectory signal in accordance with the evaluation data. The modified signal is then output to the buffer 902, replacing the previously stored signal and the evaluation process repeated. If the modified trajectory signal conforms to the predetermined criteria it is output to the microphone simulation module 814 as the damped virtual microphone trajectory, otherwise, a further iteration of modification and re-evaluation occurs. Of course, if the initial trajectory signal conforms to the given constraints, no modification will occur and the un-modified signal is output to the simulation module.

In the embodiments of the present invention described above, the signals from the microphone array simply represent the set of sound sources captured by the individual microphones at any given time. However, it is possible to analyse the sound signals to identify individual sound sources and to extract information regarding the position of the sound sources relative to the microphones. The result of such analysis is generally referred to as spatial sound. In fact, the human hearing system employs spatial sound techniques as a matter of course to identify where a particular sound source is located and to track its trajectory. Whilst it is possible to perform spatial sound analysis to determine the position and orientation of a sound source solely from the microphone array signals it is less computationally intensive and generally more accurate to utilise the motion information signal during the spatial sound analysis.

Figure 10:
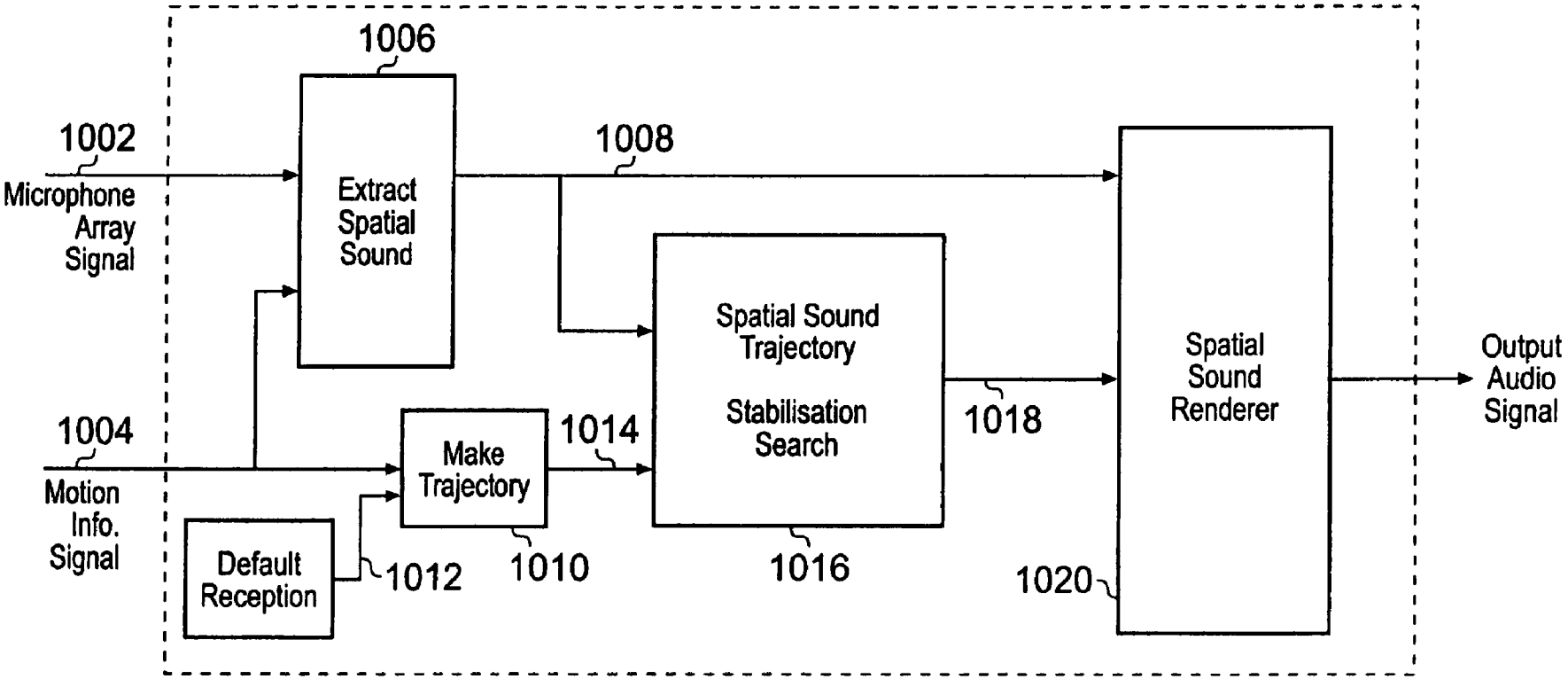
FIG. 10 schematically illustrates a further embodiment of the present invention utilising a spatial sound signal.

FIG. 10 illustrates an embodiment of the present invention in which spatial sound data is used to enhance the stabilisation of the output audio signal by enabling an improved smoothing of the virtual microphone trajectory. A spatial sound analysis module 1006 receives as inputs the signals 1002 from the microphone array and the motion information signal 1004 and performs sound analysis on the input signals to extract a spatial sound signal 1008 that is provided as an output from the analysis module 1006. The motion information signal 1004 is also provided as an input to a virtual trajectory module 1010 together with a default reception signal 1012, that derives a virtual microphone trajectory signal 1014 in an analogous manner to that described with reference to FIGS. 8 and 9. The virtual microphone trajectory signal 1014 and the spatial sound signal 1008 are provided as inputs to a trajectory stabilisation module 1016. Whereas in the previous embodiments of the invention described with reference to FIGS. 8 and 9, the virtual microphone trajectory was stabilised, or damped, by applying one or more damping functions or constraints, the virtual microphone trajectory module 1016 of the embodiment shown in FIG. 10 is stabilised in accordance with the spatial sound signal to provide a virtual microphone trajectory signal 1018 that more accurately conforms to the movement of the sound sources captured by the microphone array, as determined by the spatial sound analysis. The virtual microphone trajectory signal 1018 and the spatial sound signal 1008 are both provided as inputs to a spatial sound rendering module 1020. The spatial sound rendering module 1020 is broadly analogous to the microphone simulation modules described previously in relation to other embodiment of the invention in that it applies the virtual microphone trajectory signal 1018 to the spatial sound signal 1008, for example, by a resampling process, to generate an output audio signal representative of the output from the virtual microphone.

Figure 11:
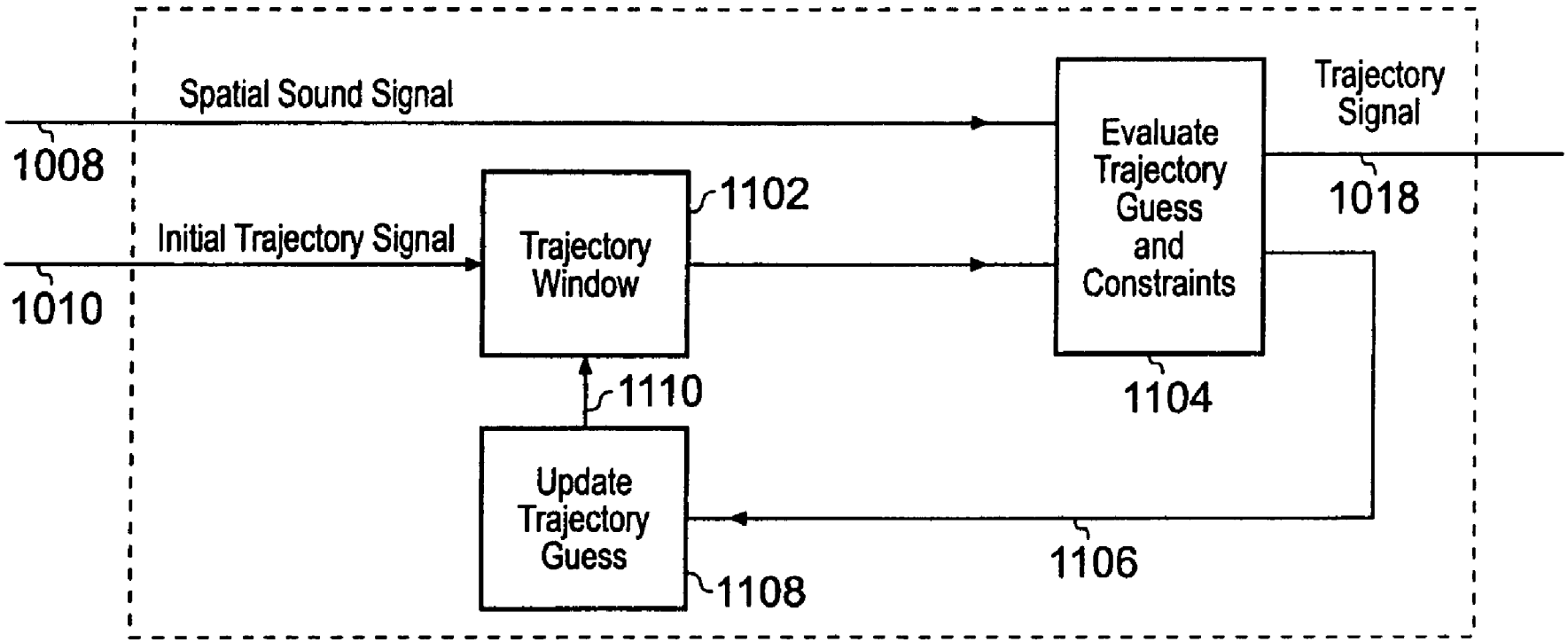
FIG. 11 schematically illustrates an iterative process of trajectory damping applicable to the embodiment of FIG. 10.

As with the embodiment of the invention described with reference to FIG. 9, the stabilisation of the virtual microphone trajectory using the spatial sound signal may be accomplished using an iterative search approach, as illustrated in FIG. 11. In an analogous manner, a buffer 1102 is provided to store the initial virtual microphone signal 1010 over the time period for which stabilisation is to occur. The buffer output is provided as an input to an evaluation module 1104, that also receives the spatial sound signal 1008 as a further input. The evaluation module 1104 evaluates the extent to which the trajectory signal conforms, within given constraints, to the positional content of the spatial sound signal. If the extent of conformity is not acceptable, an evaluation signal 1106 is output from the evaluation module 1104 and input to a trajectory modification module 1108 that subsequently generates a control signal 1110 that is received by the buffer 1102 and causes the trajectory signal stored therein to be modified. Alternatively, the trajectory signal may be output from the evaluation module 1104 together with the evaluation signal 1106 and directly modified by the modification module 1108, which then outputs the modified trajectory signal to the buffer 1110, replacing the previous contents of the buffer. The evaluation and modification cycle is repeated until the microphone trajectory signal meets the evaluation criteria, or until a maximum number of iterations have been made, at which point it is output to the spatial sound rendering module 1020 (not shown).

As mentioned above, the spatial sound signal includes information on individually identified sound sources, including their variation in terms of their position and orientation. The spatial sound analysis can be made using either an absolute frame of reference or be relative to the microphone array. In the embodiments of the present invention described herein, an absolute frame of reference is assumed. Consequently, it is possible to evaluate the proposed virtual microphone trajectory on the basis of whether or not a particular sound source will be absent or present for that trajectory, on the basis of the position and orientations of the sound source and the virtual microphone position, orientation and reception. By using this information, the rendered spatial sound output can be stabilised in terms of minimising the variation in the presence or absence of sound sources, since it is undesirable for sound sources to oscillate in and out of the field of view of the virtual microphone as its trajectory varies.

Figure 12:
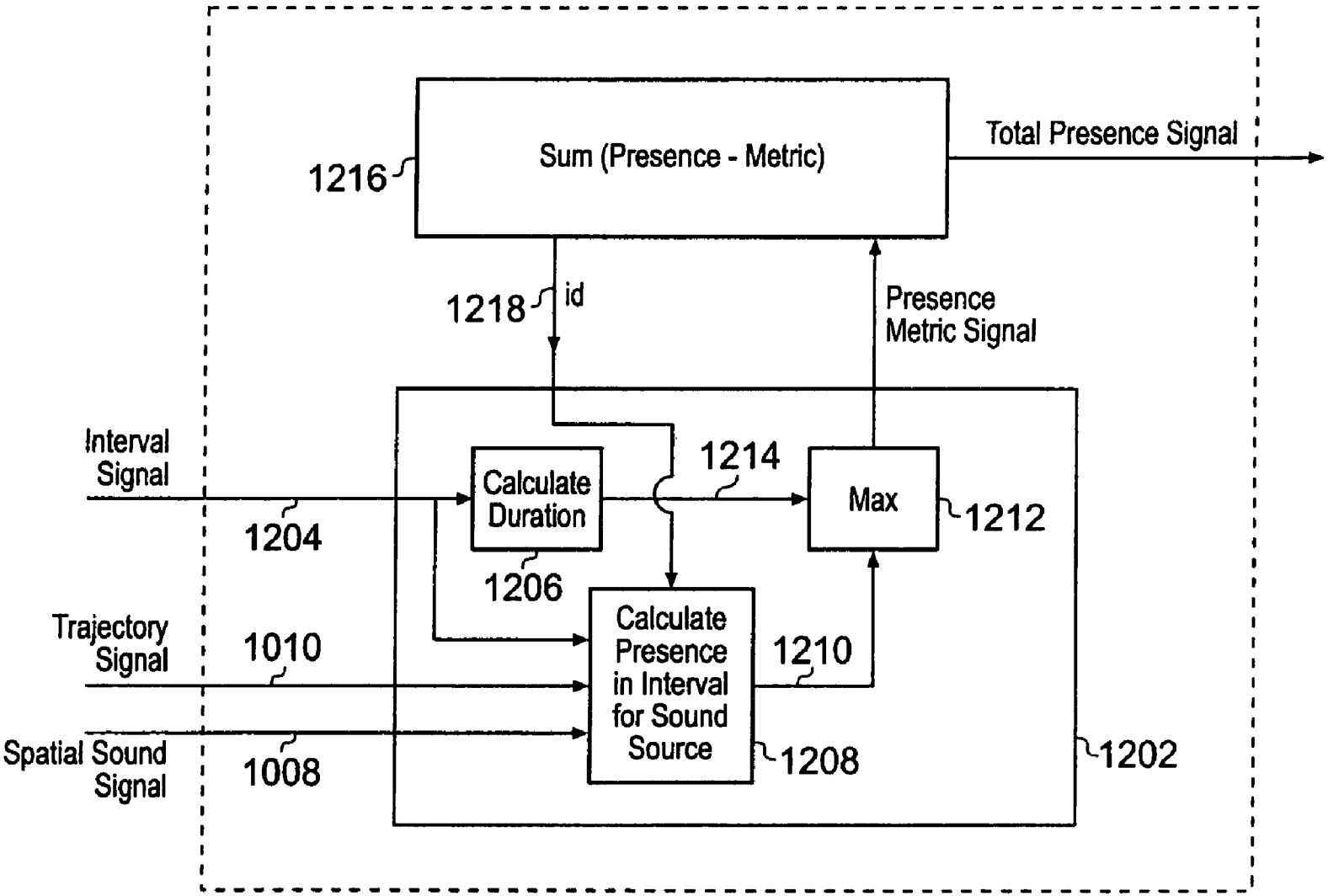
FIG. 12 schematically illustrates an arrangement according to an embodiment of the present invention for determining the presence of a sound source in a spatial sound signal.

In FIG. 12, a mechanism according to an embodiment of the present invention for determining the presence or absence of a sound source for a given virtual microphone trajectory is illustrated. The initial virtual microphone trajectory signal 1010 and spatial sound signal 1008 are provided as inputs to a sound source presence module 1202, together with an interval signal 1204. The interval signal indicates the start and finish of the time interval over which the presence or absence of a sound source is determined. The interval signal 1204 is also provided as an input to an interval duration module 1206 that calculates the duration of the time interval. It will be appreciated that in other embodiments the duration of the time interval may be fixed. The input signals are provided to a presence calculation module 1208 that determines the presence or absence of a sound source relative to the virtual microphone from the information available from the spatial sound signal 1008 and trajectory signal 1010. The results of this calculation are summed over the time interval to provide an overall indication of the presence or absence of a sound source over the time interval. The output presence signal 1210 provided by the presence calculation module 1208 is input to a sound presence metric module 1212, together with a time interval duration signal 1214 from the interval duration module 1206. The sound presence metric module 1212 calculates a metric value for the sound source based on its input signals. The metric value is provided as an input to a metric summation module 1216 that sums the metric values for each identified sound source. The metric summation module also provides a sound source identification (ID) signal 1218 to the presence calculation module 1208, so that the presence of individual sound sources can be determined. The summed metrics are output from the metric summation module 1216 and can be provided as an input to trajectory calculation module 1016 shown in FIG. 10.

The provision of the time interval signal 1204 may be bounded by certain constraints. For example, a minimum duration of time interval may be imposed or a maximum number of separate intervals allowed over a given time period. A gap between time intervals may also be imposed, the gap providing a transition between sound sources being present or absent.

In the embodiment of the present invention described above with reference to FIG. 12, each individual sound source is treated in the same way. However, a further improvement in the determination of the virtual microphone trajectory, and hence the stabilisation of the output audio signal, can be achieved if the relevant importance and relevance of individual sound sources is taken into account. Such characteristics of the sound sources is referred to as their saliency. A measure of the saliency of an individual sound source can be calculated from the spatial sound signal and the virtual microphone trajectory and will vary over time. Methodologies and processes for calculating audio saliency are known and are therefore not disclosed in this application.

Figure 13:
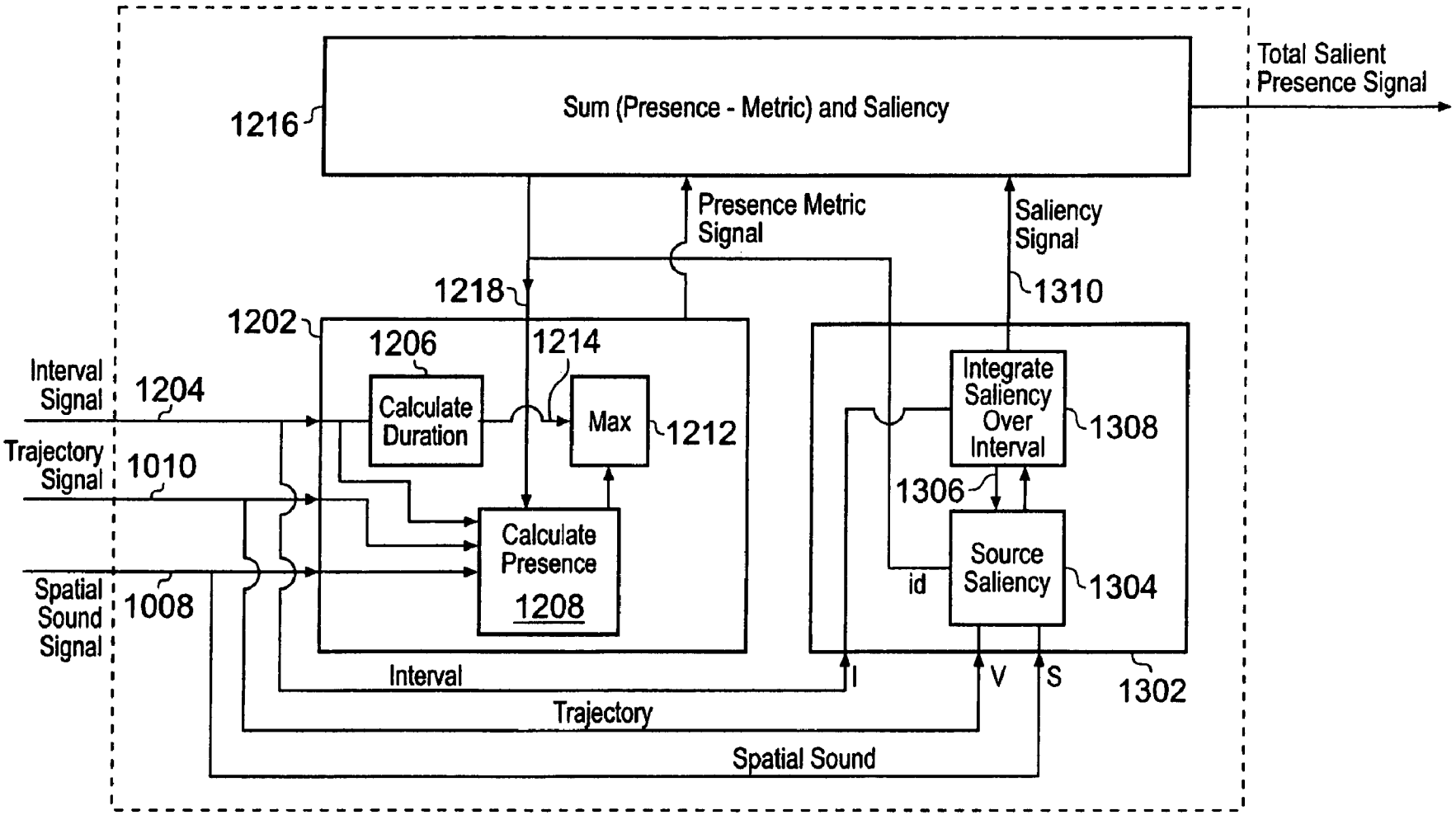
FIG. 13 schematically illustrates the arrangement of FIG. 12 with the addition of a further arrangement for determining the saliency of a sound source.

FIG. 13 illustrates a variant of the arrangement shown in FIG. 12 calculating a metric value for the presence or absence of a sound source in which the saliency of the sound source is also taken into account. Where identical items are included, the same reference numerals are applied. In addition to the arrangement shown in FIG. 12, in the arrangement shown in FIG. 13 a saliency module 1302 is provided, included in which is a saliency calculation module 1304. The spatial sound signal 1008, virtual microphone trajectory signal 1010 and sound source identification (ID) signal 1218 are provided as inputs to the saliency calculation module 1304, together with a time signal 1306 derived from the time interval signal 1204. From these inputs, a saliency measure for the identified sound source at any given point of time is calculated. The output of the saliency calculation module is provided as an input to a saliency integration module 1308, that also receives the time interval signal 1204 and generates the time signal 1306 provided as an input to the saliency calculation module 1304. The saliency integration module 1308 sums the saliency measures received from the saliency calculation module 1304 over the duration of the time interval to provide a saliency value 1310 for the identified sound source. The metric summation module 1216 now combines the saliency signal 1310 with the sound presence metric value before doing the summation. The combination of the signals may be accomplished in accordance with any predetermined function. For example, the saliency and metric values may be simply multiplied together. The output from the metric summation module 1216 is provided, as for the embodiment shown in FIG. 12, as an input to the trajectory calculation module (not shown). Consequently, the trajectory of the virtual microphone is influenced by the presence or absence of salient sound sources, with the aim being to ensure that the most salient sound source is present, or indeed absent, from the output audio signal.

A further mechanism for the stabilisation of the output sound signal is for the virtual microphone trajectory to be such that the most salient sound sources are included in the output audio signal, regardless of whether or not this results in a sound source moving in and out of the reception of the virtual microphone as the saliency of the sound source varies over time. This can be accomplished by using a mechanism similar to that shown in FIG. 13, with the deletion of the presence calculation processes.

Figure 14:
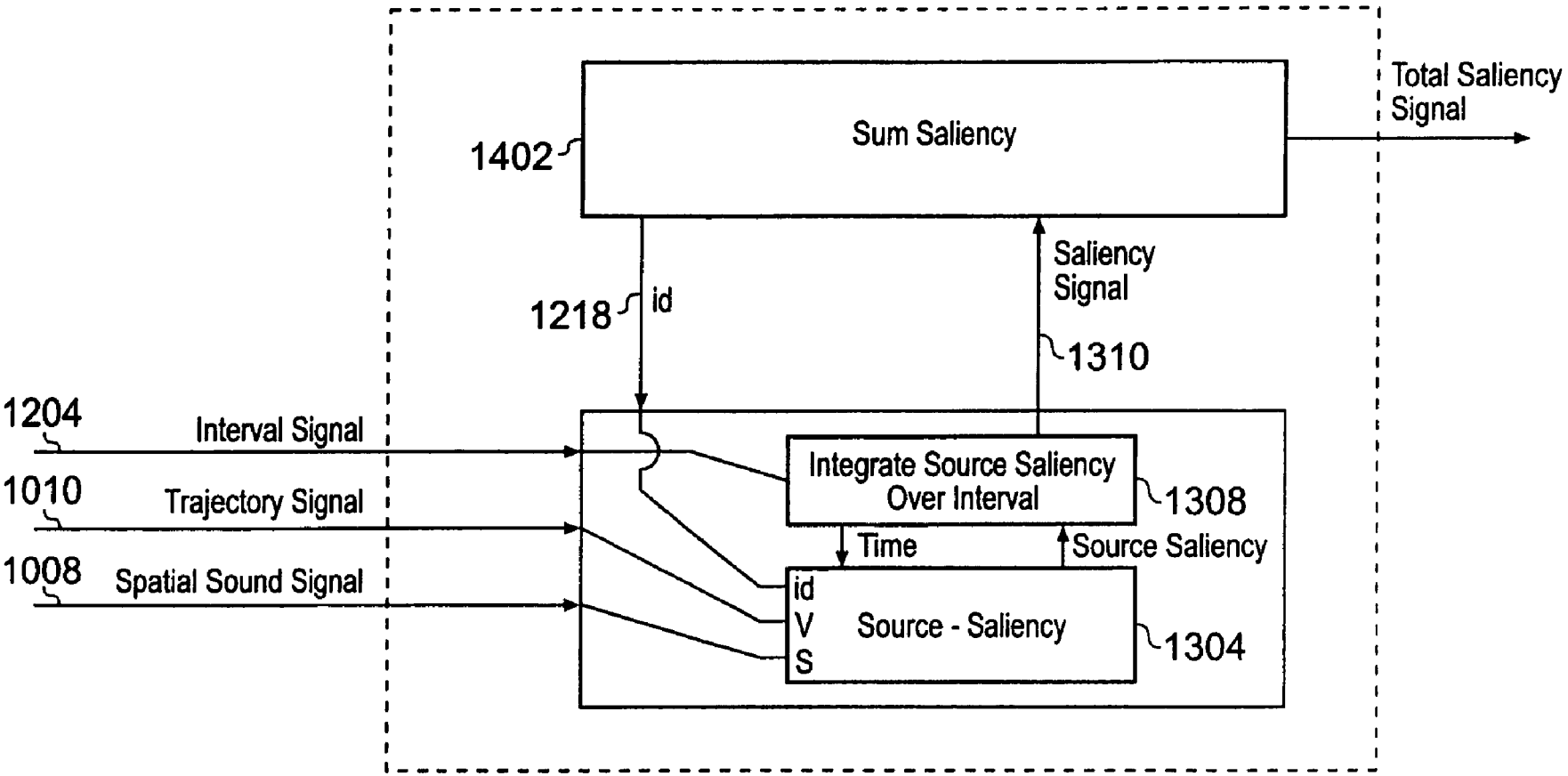
FIG. 14 schematically illustrates an arrangement according to an embodiment of the present invention for determining the most salient sound source.

An alternative embodiment may be configured to determine solely the most salient sound sources is shown in FIG. 14. The virtual microphone trajectory signal 1010, spatial sound signal 1008 and sound source identification (ID) signal 1218 are provided as inputs to a saliency calculation module 1304 that calculated an instantaneous measure of the saliency of the identified sound source. The saliency measure is provided to a saliency integration module 1308 that sums the received saliency measures over the duration of the time interval defined by the interval signal 1204 provided as a further input. This is identical to the operation of the saliency module 1302 described with reference to FIG. 13. The output of the saliency integration module, shown in FIG. 14 as signal 1310 and being representative of a measure of the sound source saliency over the defined time interval, is provided as an input to maximum saliency selection module 1402 that is arranged to determine which sound source has the maximum saliency measure. The output from the saliency selection module is provided as an input to the virtual microphone trajectory module 1016 shown in FIG. 10 such that the trajectory stabilisation seeks to keep the most salient sound source within the field of view of the virtual microphone.

Figure 15:
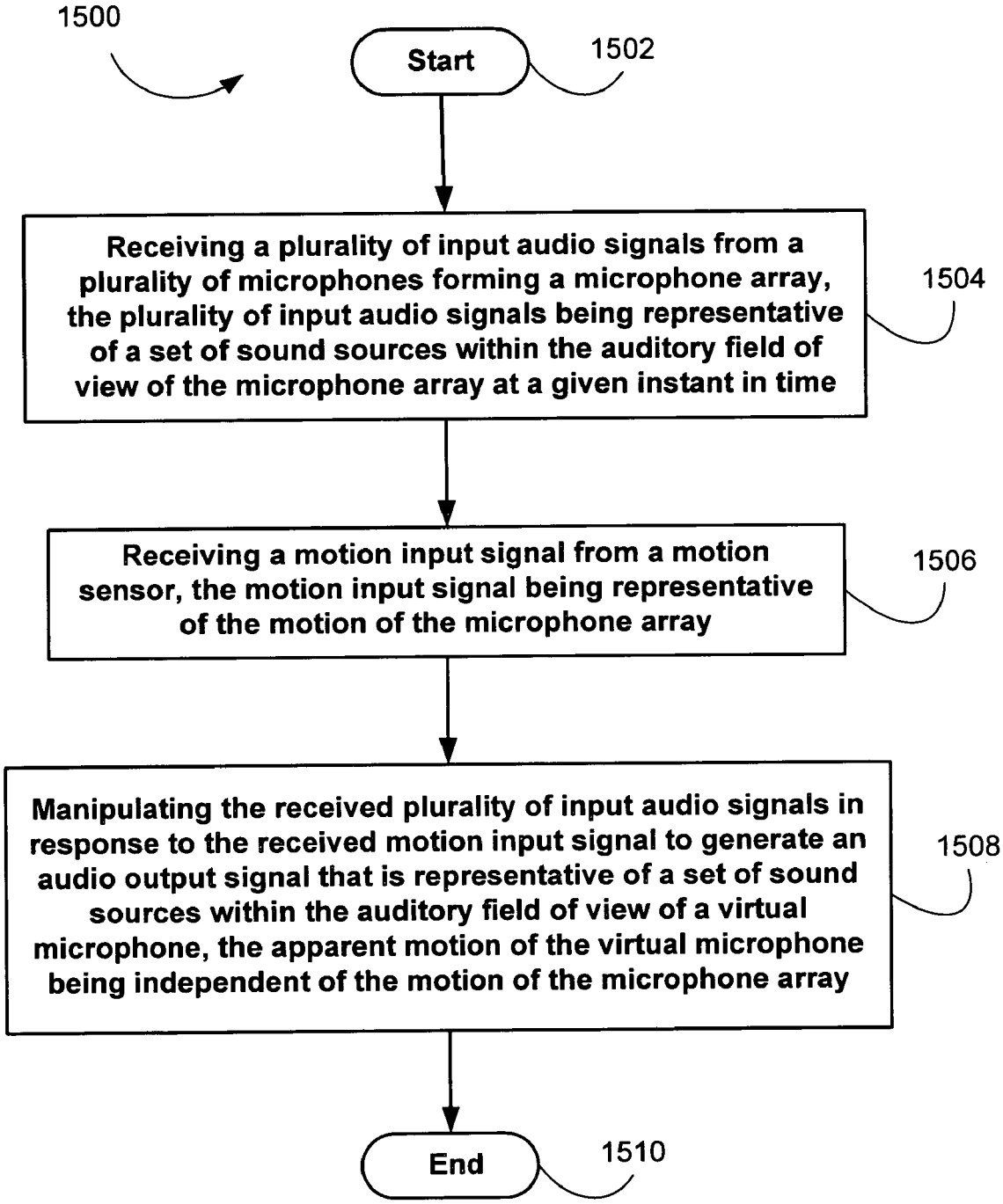
FIG. 15 is a flowchart illustrating an embodiment of a process for generating an audible signal.

The flow chart 1500 of FIG. 15 shows the architecture, functionality, and operation of an embodiment for generating an audible signal. An alternative embodiment implements the logic of flow chart 1500 with hardware configured as a state machine. In this regard, each block may represent a module, segment or portion of code, which comprises one or more executable instructions for implementing the specified logical function(s). It should also be noted that in alternative embodiments, the functions noted in the blocks may occur out of the order noted in FIG. 15, or may include additional functions. For example, two blocks shown in succession in FIG. 15 may in fact be substantially executed concurrently, the blocks may sometimes be executed in the reverse order, or some of the blocks may not be executed in all instances, depending upon the functionality involved, as will be further clarified hereinbelow. All such modifications and variations are intended to be included herein within the scope of this disclosure.

The process begins at block 1502. At block 1504, a plurality of input audio signals is received from a plurality of microphones forming a microphone array, the plurality of input audio signals being representative of a set of sound sources within the auditory field of view of the microphone array at a given instant in time. At block 1506, a motion input signal is received from a motion sensor, the motion input signal being representative of the motion of the microphone array. At block 1508, the received plurality of input audio signals are manipulated in response to the received motion input signal to generate an audio output signal that is representative of a set of sound sources within the auditory field of view of a virtual microphone, the apparent motion of the virtual microphone being independent of the motion of the microphone array. The process ends at block 1510.

In accordance with the flow chart 1500, the plurality of input audio signals are preferably manipulated such that the apparent orientation of the virtual microphone is damped with respect to the orientation of the microphone array. The method may additionally comprise determining the orientation of the microphone array from the motion input signal and apply a damping function to the determined orientation, the damped orientation being representative of the orientation of the virtual microphone. Furthermore, the step of applying a damping function may comprise calculating the trajectory of the microphone array from the motion input signal, determining the difference between the microphone array orientation and trajectory and applying one or more constraints to the determined difference.

Additionally or alternatively, the process of manipulating the received plurality of input audio signals may comprise applying a weighting to each of the input signals and combining the weighted signals. Additionally, the weighting applied to each input audio signal may be in the range of 0-100% of the received input signal value.

Additionally or alternatively, the signal weighting is determined according to the damped microphone orientation and field of view of the microphone array. The signal weighting may be further determined according to the configuration of each microphone in the array.

In a further embodiment, the plurality of input audio signals may be manipulated such that the apparent trajectory of the virtual microphone is damped with respect to the trajectory of the microphone array. This may be achieved by determining the trajectory of the virtual microphone and applying a damping function to the determined trajectory. The step of applying the damping function preferably comprises iteratively evaluating the determined trajectory against one or more predetermined criteria and modifying the determined trajectory in response to the evaluation.

In addition, the process may comprise analysing the plurality of the input audio signals to extract spatial sound information, determining the trajectory of the virtual microphone, modifying the virtual microphone trajectory in accordance with the extracted spatial sound information and manipulating the spatial sound information in accordance with the modified virtual microphone trajectory to generate the audio output signal.

In addition, the process may further comprise determining from the spatial sound information the presence of an individual sound source within the auditory field of view of the virtual microphone over a given time interval and modifying the virtual microphone trajectory in accordance with the determined sound source presence. The trajectory may be modified so as to substantially maintain the presence of a selected sound source within the auditory field of view of the virtual microphone.

Additionally or alternatively, the process may further comprise determining from the spatial sound information the saliency of an individual sound source and modifying the virtual microphone trajectory in accordance with the determined sound source saliency. In addition, the virtual microphone trajectory may be modified so as to substantially maintain a selected sound source within the auditory field of view of the virtual microphone, the sound source being selected in dependence on the saliency of the sound source.

According to another embodiment, there is provided a computer program product comprising a plurality of computer readable instructions that when executed by a computer cause that computer to perform the method of the first embodiment. The computer program is preferably embodied on a program carrier.

According to yet another embodiment, there is provided an audio signal processor comprising a first input for receiving a plurality of input audio signals from a plurality of microphones forming a microphone array, a second input for receiving a motion input signal representation of the motion of the microphone array, a data processor arranged to perform the method of the first embodiment and an output for providing the generated audio output signal.

According to another embodiment, there is provided an audio signal generating system comprising a microphone array comprising a plurality of microphones, each microphone being arranged to provide an input audio signal, a motion sensor arranged to provide a motion input signal representation of the motion of the microphone array and an audio signal processor according to the third embodiment.

It should be emphasised that the above-described embodiments are merely examples of the disclosed system and method. Many variations and modifications may be made to the above-described embodiments. All such modifications and variations are intended to be included herein within the scope of this disclosure.

What is claimed is:

1. A method of generating an audio signal, the method comprising:

receiving a plurality of input audio signals from a plurality of microphones forming a microphone array, the plurality of input audio signals being representative of a set of sound sources within an auditory field of view of the microphone array at a given instant in time;

receiving a motion input signal from a motion sensor, the motion input signal being representative of the motion of the microphone array; and manipulating the received plurality of input audio signals in response to the received motion input signal to generate an audio output signal that is representative of a set of sound sources within the auditory field of view of a virtual microphone, the apparent motion of the virtual microphone being independent of the motion of the microphone arrays, wherein manipulating further comprises, generating an orientation signal that represents the orientation of the plurality of microphones and a trajectory signal that represents the trajectory of the plurality of microphones from the motion input signal, generating a difference signal representing a difference between the orientation signal and the trajectory signal, damping the difference signal, adding the damped difference signal to the trajectory signal, and providing a damped orientation signal representing an apparent orientation of the virtual microphone.

2. A method according to claim 1, wherein damping the difference signal further comprises:

applying one or more constraints to the difference signal.

3. A method according to claim 1, wherein the step of manipulating the received plurality of input audio signals further comprises:

applying a weighting to each of the input signals; and combining the weighted signals.

4. A method according to claim 3, wherein the weighting applied to each input audio signal is in the range of 0-100% of a received input signal value.

5. A method according to claim 3, wherein the signal weighting is determined according to the damped microphone orientation and field of view of the microphone array.

6. A method according to claim 5, wherein the signal weighting is further determined according to the configuration of each microphone in the array.

7. A computer-readable medium encoded with computer executable logic configured to perform:

receiving a plurality of input audio signals from a plurality of microphones forming a microphone array, the plurality of input audio signals being representatives of a set of sound sources within auditory field of view of the microphone array at a given instant in time;

reviving a motion input signal from a motion sensor, the motion input signal being representative of the motion of the microphone array;

manipulating the received plurality of input audio signals in response to the received motion input signal to generate an audio output signal that is representative of a set of sound sources within the auditory field of view of a virtual microphone, the apparent motion of the virtual microphone being independent of the motion of the microphone array, wherein manipulating further comprises, generating an orientation signal that represents the orientation of the plurality of microphones and a trajectory signal that represents the trajectory of the plurality of microphones from the motion input signal, generating a difference signal representing a difference between the orientation signal and the trajectory signal, damping the difference signal, adding the damped difference signal to the trajectory signal, and providing a damped orientation signal representing an apparent orientation of the virtual microphone.

8. An audio signal processor comprising:

a first input for receiving a plurality of input audio signals from a plurality of microphones forming a microphone array;

a second input for receiving a motion input signal from a motion sensor, the motion input signal being representative of the motion of the microphone array;

a data processor connected to the first input and the second input, and arranged to:

receive the plurality of input audio signals from the plurality of microphones forming a microphone array, the plurality of input audio signals being representative of a set of sound sources within an auditory field of view of the microphone array at a given instant in time;

receive the motion input signal from the motion sensor, the motion input signal being representative of the motion of the microphone array;

manipulate the received plurality of input audio signals in response to the received motion input signal to generate an audio output signal that is representative of a set of sound sources within the auditory field of view of a virtual microphone, the apparent motion of the virtual microphone being independent of the motion of the microphone array; and generate an audio output signal; and an output for providing the generated audio output signal, wherein manipulate the received plurality of audio input signals further comprises, generate an orientation signal that represents the orientation of the plurality of microphones and a trajectory signal that represents the trajectory of the plurality of microphones from the motion input signal, generate a difference signal representing a difference between the orientation signal and the trajectory signal, damp the difference signal, add the damped difference signal to the trajectory signal, and provide a damped orientation signal representing an apparent orientation of the virtual microphone.

9. An audio signal generating system comprising:

a microphone array comprising a plurality of microphones, each microphone being arranged to provide an input audio signal;

a motion sensor arranged to provide a motion input signal representative of the motion of the microphone array; and an audio signal processor according to claim 8.

10. A method of generating an audio signal, the method comprising:

receiving a plurality of input audio signals from a plurality of microphones forming a microphone array, the plurality of input audio signals being representative of a set of sound sources within an auditory field of view of the microphone array at a given instant in time;

receiving a motion input signal from a motion sensor, the motion input signal being representative of the motion of the microphone array; and manipulating the received plurality of input audio signals in response to the received motion input signal to generate an audio output signal that is representative of a set of sound sources within the auditory field of view of a virtual microphone, the apparent motion of the virtual microphone being independent of the motion of the microphone array, wherein manipulating further comprises:

determining an initial trajectory signal for the virtual microphone from the motion input signal;

repeatedly modifying the initial trajectory signal until the initial trajectory signal conforms to one or more predetermined criteria, and generating the conforming trajectory signal as an apparent trajectory signal for the virtual microphone.

11. A method according to claim 10, wherein repeatedly modifying the initial trajectory signal further comprises:

iteratively evaluating the determined trajectory signal against the one or more predetermined criteria; and modifying the determined trajectory signal in response to the evaluation.

12. A method according to claim 10, further comprising:

analysing the plurality of the input audio signals to extract spatial sound information;

determining the trajectory of the virtual microphone;

modifying the virtual microphone trajectory in accordance with the extracted spatial sound information; and manipulating the spatial sound information in accordance with the modified virtual microphone trajectory to generate the audio output signal.

13. A method according to claim 12, further comprising:

determining from the spatial sound information the presence of an individual sound source within the auditory field of view of the virtual microphone over a given time interval; and modifying the virtual microphone trajectory in accordance with the determined sound source presence.

14. A method according to claim 13, wherein the virtual microphone trajectory is modified so as to substantially maintain the presence of a selected sound source within the auditory field of view of the virtual microphone.

15. A method according to claim 12, further comprising:

determining from the spatial sound information the saliency of an individual sound source; and modifying the virtual microphone trajectory in accordance with the determined sound source saliency.

16. A method according to claim 15, wherein the virtual microphone trajectory is modified so as to substantially maintain the selected sound source within the auditory field of view of the virtual microphone, the sound source being selected in dependence on the saliency of the sound source.

* * * * *